US009216494B2

(12) United States Patent
Lai

(10) Patent No.: US 9,216,494 B2
(45) Date of Patent: Dec. 22, 2015

(54) PINCER STRUCTURE

(71) Applicant: Chiu-Chi Lai, Taichung (TW)

(72) Inventor: Chiu-Chi Lai, Taichung (TW)

( * ) Notice: Subject to any disclaimer, the term of this patent is extended or adjusted under 35 U.S.C. 154(b) by 330 days.

(21) Appl. No.: 13/793,902

(22) Filed: Mar. 11, 2013

(65) Prior Publication Data

US 2014/0251093 A1 Sep. 11, 2014

(51) Int. Cl.
*B25B 7/12* (2006.01)

(52) U.S. Cl.
CPC ..... *B25B 7/123* (2013.01)

(58) Field of Classification Search
CPC ..... B25B 7/123
See application file for complete search history.

(56) References Cited

U.S. PATENT DOCUMENTS

| | | | | | |
|---|---|---|---|---|---|
| 2,853,910 | A * | 9/1958 | Petersen | 81/368 |
| 3,496,808 | A * | 2/1970 | Schmidt | 81/370 |
| 3,545,316 | A * | 12/1970 | Patrick | 81/368 |
| 4,820,901 | A * | 4/1989 | Peviani | 219/138 |
| 4,889,022 | A * | 12/1989 | Peviani | 81/368 |
| 5,056,385 | A * | 10/1991 | Petersen | 81/370 |
| 5,233,893 | A * | 8/1993 | Schmidt | 81/368 |
| 5,460,065 | A * | 10/1995 | Balmer | 81/368 |
| 6,626,070 | B2 * | 9/2003 | Peperkorn et al. | 81/370 |
| 8,024,998 | B1 * | 9/2011 | Valencia | 81/368 |
| 8,656,813 | B1 * | 2/2014 | Aldredge et al. | 81/427.5 |
| 8,919,229 | B1 * | 12/2014 | Aldredge et al. | 81/376 |
| 2007/0209484 | A1 * | 9/2007 | Chervenak et al. | 81/368 |
| 2007/0251291 | A1 * | 11/2007 | LaVallee | 72/409.13 |
| 2008/0196561 | A1 * | 8/2008 | Wu | 81/329 |
| 2011/0107880 | A1 * | 5/2011 | Stucky | 81/370 |
| 2013/0239759 | A1 * | 9/2013 | Huang | 81/370 |

* cited by examiner

*Primary Examiner* — Joseph J Hail
*Assistant Examiner* — Marc Carlson

(57) ABSTRACT

A pincer structure includes a first body having an immovable palate and an immovable stem, a second body having a movable palate and a movable stem, a clipping space defined by the movable palate and the immovable palate, the movable stem pivoted on the movable palate, an elastomer elastically connected between the movable palate and the immovable stem, a limiting member extruded from the movable stem, the limiting member having an abutting unit, a pivoting member pivoted on the movable stem, the pivoting member having an abutting portion, the abutting portion being movable between the movable stem and the abutting unit, a connecting member having one end and another end, said one end pivotally assembled to the pivoting member and said another end movably assembled to the immovable stem. Therefore, a recovery force of the elastomer makes the operation smooth.

6 Claims, 6 Drawing Sheets

PINCER STRUCTURE

BACKGROUND OF THE INVENTION

1. Field of the Invention

The present invention relates to a pincer structure.

2. Description of the Prior Art

In regards to U.S. Pat. No. 6,626,070, a conventional pincer structure comprises a movable stem. The movable stem has two limiting members respectively extended form two lateral sides thereof. A limiting space is defined by the two limiting members and a bottom of the movable stem. A pivoting member is pivoted on the movable stem and is received into the limiting space. When the movable stem pivots away from an immovable stem, the two limiting members push against the pivoting member; then, a recovery force of an elastomer pulls a movable palate away from an immovable palate; thereafter, the movable stem is moved away from the immovable stem via motions of the movable palate and a connecting member. Therefore, the recovery force of the elastomer makes the operation smooth.

However, a top of each lateral side of the movable stem is very far from the bottom of the movable stem, so that a pivoting range of the pivoting member is very large. Therefore, there are four disadvantages of the conventional pincer structure, shown as following.

1. A distance between the limiting member and the bottom portion is very long, so that the user needs to forcefully rotate the movable stem away from the immovable stem so as to make the pivoting member 50 abut against the limiting member 40. It is very inconvenient for the user to operate.

2. When the user rotates the movable stem toward the immovable stem, the operation is not smooth because the pivoting range of the pivoting member is very large.

3. During operation, a plurality of pivoting rods would be worn down because a rotation range of the movable stem is very large.

4. The limiting member is very far from the pivoting member, so that a length of the pivoting member needs to be enlarged. Therefore, the cost of the pivoting member would be increased.

The present invention is, therefore, arisen to obviate or at least mitigate the above mentioned disadvantages.

SUMMARY OF THE INVENTION

An object of the present invention is to provide an improved pincer structure.

To achieve the above and other objects, a pincer structure comprises a first body having an immovable palate and an immovable stem, the immovable palate assembled at one end of the immovable stem, a second body having a movable palate and a movable stem, the movable palate pivoted on the immovable stem, a clipping space defined by the movable palate and the immovable palate, the movable stem pivoted on the movable palate, the movable stem having a bottom portion and two lateral portions, the two lateral portions of the movable stem respectively extended from two sides of the bottom portion toward a first direction, the first direction being perpendicular to the movable stem, a receiving groove defined by the bottom portion and the two lateral portions of the movable stem, an elastomer elastically connected between the movable palate and the immovable stem, a limiting member extruded from the bottom portion of the movable stem, each lateral portion extended over the limiting member, the limiting member having an abutting unit, a limiting space defined between the abutting unit and the bottom portion of the movable stem, a pivoting member pivoted on the movable stem, the pivoting member having an abutting portion, the abutting portion located in the limiting space, the abutting portion being movable between the bottom portion and the abutting unit, a connecting member having one end and another end, said one end pivotally assembled to the pivoting member and said another end movably assembled to the immovable stem. Wherein, the movable stem further has a first stem end and a second stem end; the first stem end of the movable stem is pivoted on the movable palate; the abutting portion has an abutting end extended therefrom toward the second stem end of the movable stem; the abutting end is located at the limiting space; the abutting end is selectively contacted with the abutting unit of the limiting member; the abutting unit of the limiting member is extended toward the first stem end of the movable stem; the movable stem further has a first stem end and a second stem end; the first stem end of the movable stem is pivoted on the movable palate; the pivoting member is located between the first end of the movable stem and the limiting member; the movable stem further has a first stem end and a second stem end; the first stem end of the movable stem is pivoted on the movable palate; the connecting member has an extruded portion extruded therefrom; when the extruded portion abuts against the bottom portion of the movable stem, the limiting member is located between the extruded portion and the first stem end of the movable stem; the abutting portion has a through hole; the limiting member passes through the through hole; the limiting member is hook-shaped; when the connecting member abuts against the bottom portion of the movable stem, the limiting member is adjacent to one side of the connecting member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
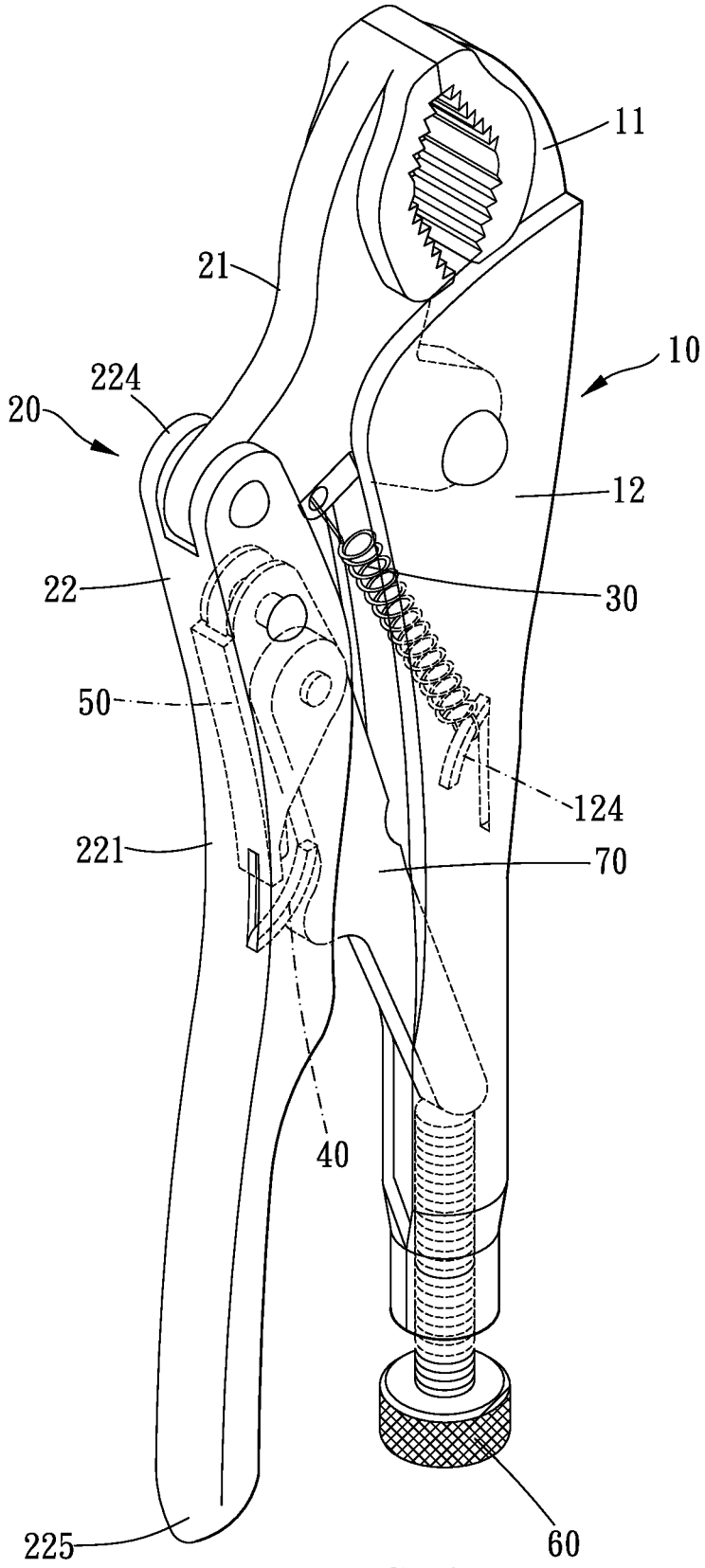
FIG. 1 is a perspective view of a pincer structure according to a preferred embodiment of the present invention.
Figure 2:
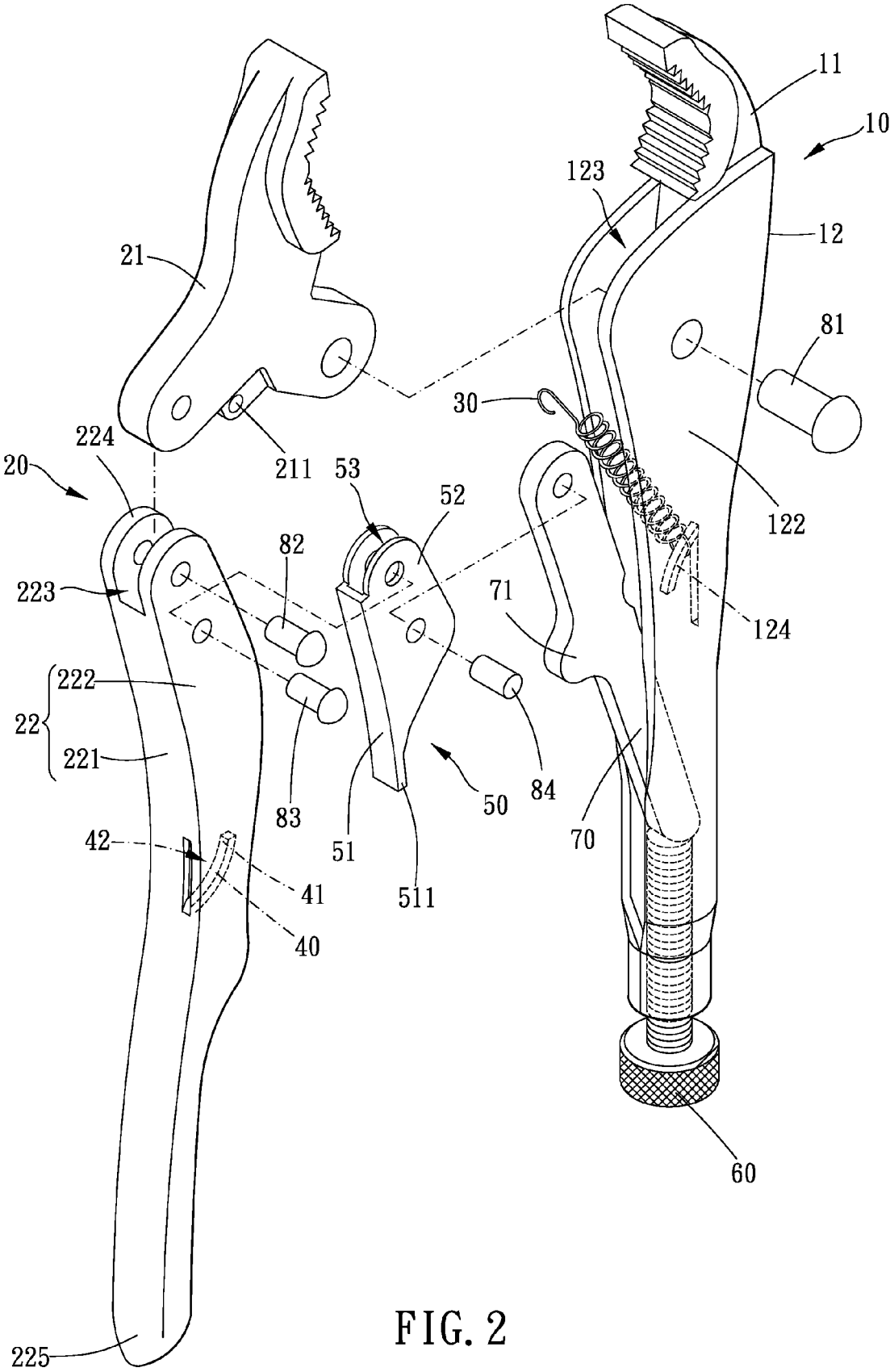
FIG. 2 is an exploded perspective view of the present invention.
Figure 3:
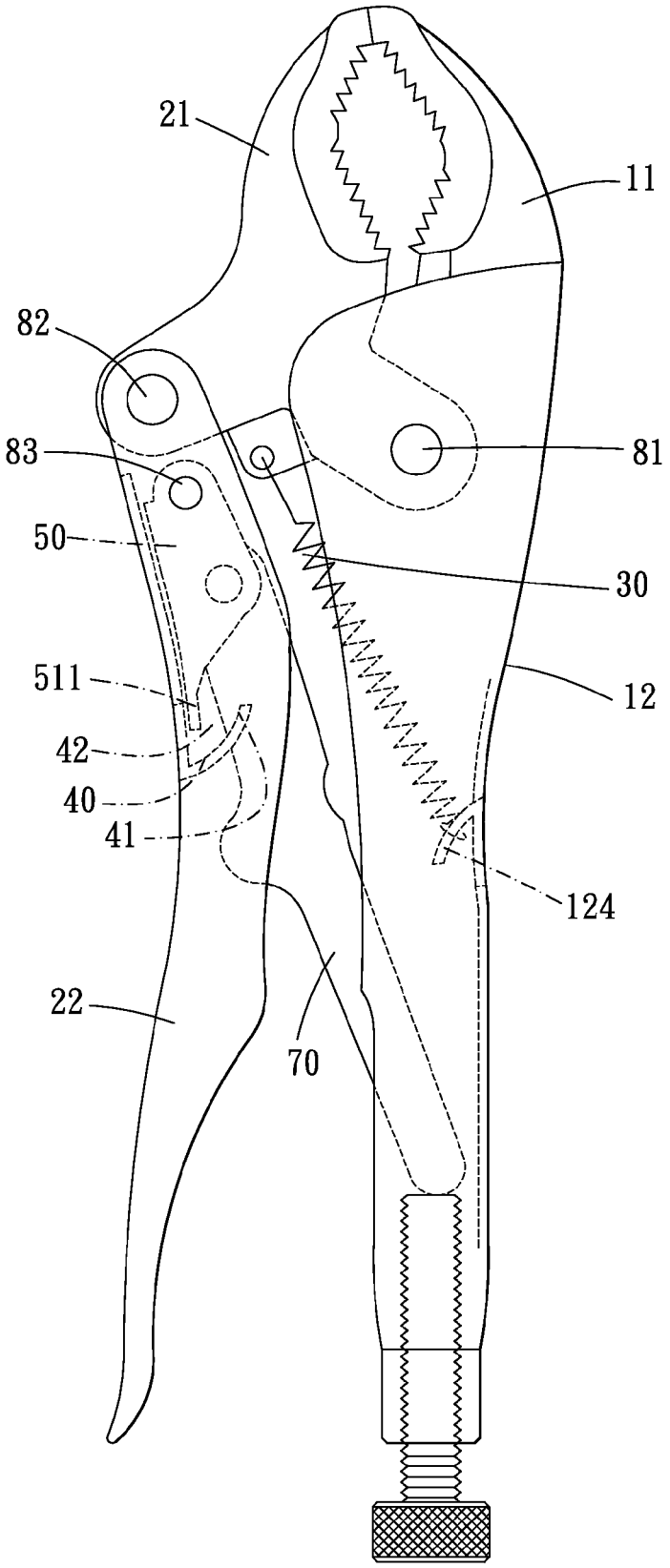
FIG. 3 is a side view for showing the pincer structure under operation.

FIGS. 1-3 show a pincer structure according to a preferred embodiment of the present invention. The pincer structure includes a first body 10, a second body 20, an elastomer 30, a limiting member 40, a pivoting member 50, an adjusting screw 60 and a connecting member 70. The first body 10 has an immovable palate 11 and an immovable stem 12. The immovable stem 12 has two ends which are respectively defined as a first end and a second end. The immovable palate 11 is assembled at the first end of the immovable stem 12. The immovable stem 12 further has a bottom and two side portions 122. A receiving space 123 is defined by the bottom and the two side portions 122 of the immovable stem 12.

The second body 20 has a movable palate 21 and a movable stem 22. A first pivoting rod 81 passes through the movable palate 21 and the two side portions 122 of the immovable stem 12 so that the movable palate 21 is pivoted on the immovable stem 12. A clipping space is defined by the movable palate 21 and the immovable palate 11. The movable stem 22 has a bottom portion 221 and two lateral portions 222. The two lateral portions 222 of the movable stem 22 are respectively extended from two sides of the bottom portion 221 toward a first direction. The first direction is perpendicular to the movable stem 22. A receiving groove 223 is defined by the bottom portion 221 and the two lateral portions 222 of the movable stem 22. A second pivoting rod 82 passes through the movable palate 21 and the two lateral portions 222 of the movable stem 22, so that the movable stem 22 is pivoted on the movable palate 21. The movable stem 22 further has a first stem end 224 and a second stem end 225. The second pivoting rod 82 is located at the first stem end 224 of the movable stem 22. The first stem end 224 of the movable stem 22 is pivoted on the movable palate 21.

The elastomer 30 is elastically connected between the movable palate 21 and the immovable stem 12. The immovable stem 12 further has a hook 124 extruded from a bottom thereof. The movable palate 21 has a through hole 211 opened therethrough. Two ends of the elastomer 30 are respectively hooked at the hook 124 and the through hole 211. The elastomer 30 is a spring. The limiting member 40 is extruded from the bottom portion 221 of the movable stem 22. Each lateral portion 222 is extended over the limiting member 40 so that the limiting member 40 is received in the receiving groove 223 and would not be exposed from the receiving groove 223. The limiting member 40 has an abutting unit 41. A limiting space 42 is defined between the abutting unit 41 and the bottom portion 221 of the movable stem 22. The limiting member 40 is hook-shaped (a shape of the limiting member 40 is not limited by the present claimed invention). The limiting member 40 and the movable stem 22 are integrated with each other. The pivoting member 50 is located between the first stem end 224 of the movable stem 22 and the limiting member 40.

The pivoting member 50 is pivoted on the movable stem 22. The pivoting member 50 has an abutting portion 51. The abutting portion 51 is located in the limiting space 42. The abutting portion 51 is movable between the bottom portion 221 and the abutting unit 41. The pivoting member 50 further has two pivoting plates 52. The two pivoting plates 52 are respectively extended from two sides of the abutting portion 51. A pivoting space 53 is defined by the two pivoting plates 52 and the abutting portion 51. A third pivoting rod 83 passes through the two lateral portions 222 of the movable stem 22 and the two pivoting plates 52 so that the pivoting member 50 is pivotally assembled in the receiving groove 223 of the movable stem 22. The abutting portion 51 has an abutting end 511 extended therefrom toward the second stem end 225 of the movable stem 22. The abutting end 511 is located at the limiting space 42. The limiting member 40 is located between the pivoting member 50 and the second stem end 225 of the movable stem 22. The abutting unit 41 of the limiting member 40 is extended toward the first stem end 224 of the movable stem 22 so that the abutting end 511 is selectively contacted with the abutting unit 41 of the limiting member 40. The limiting member 40 might be adjacent to one side of the abutting end 511 so that the limiting member 40 is located between the abutting end 511 and one lateral portion 222 of the movable stem 22 and is extended toward another lateral portion 222 of the movable stem 22. The abutting portion 51 might have a through hole (not shown) instead of the abutting end 511; the through hole communicates with the pivoting space 53; the limiting member 40 passes through the through hole; the abutting unit 41 of the limiting member 40 can be extended toward any direction.

The adjusting screw 60 is movably assembled at the second end of the immovable stem 12.

A fourth pivoting rod 84 passes through one end of the connecting member 70 and the two pivoting plates 52 of the pivoting member 50 so that one end of the connecting member 70 is pivotally assembled into the pivoting space 53 of the pivoting member 50. The third pivoting rod 83 is located between the second pivoting rod 82 and the fourth pivoting rod 84. Another end of the connecting member 70 is movably assembled to the immovable stem 12. Another end of the connecting member 70 is received into the receiving space 123 of the immovable stem 12 and is abutted against the adjusting screw 60. When the adjusting screw 60 is moved toward the immovable palate 11, the adjusting screw 60 pushes against another end of the connecting member 70 so that the movable stem 22 slightly moves the movable palate 21 toward the immovable palate 11 via a motion of the adjusting screw 60. In contrast, when the adjusting screw 60 is moved away from the immovable palate 11, the connecting member 70 slides away from the immovable palate 11 via the motion of the adjusting screw 60 so that the movable stem 22 slightly moves the movable palate 21 away from the immovable palate 11 via the motion of the adjusting screw 60; therefore, a size of the clipping space is adjustable. The connecting member 70 has an extruded portion 71 extruded therefrom. When the movable stem 22 moves toward the immovable stem 12, the extruded portion 71 abuts against the bottom portion 221 of the movable stem 22. The limiting member 40 is not aligned with the connecting member 70 so that the limiting member 40 would not interfere with a motion of the connecting member 70. The limiting member 40 is located between the extruded portion 71 and the first stem end 224 of the movable stem 22.

Referring to FIGS. 1-3, when the movable stem 22 pivots toward the immovable stem 12, the abutting end 511 of the abutting portion 51 of the pivoting member 50 moves away from the abutting unit 41 of the limiting member 40; then, the abutting end 511 abuts against the bottom portion 221 of the movable stem 22; thereafter, the bottom portion 221 of the movable stem 22 pushes against the pivoting member 50 via a recovery force of the elastomer 30, and the connecting member 70 pivots toward the immovable stem 12 via a motion of the pivoting member 50, and the movable palate 21 pivots toward the immovable palate 11 via a motion of the movable stem 22, until the connecting member 70 is axially aligned with the second pivoting rod 82 (as shown in FIG. 3); as a result, although the recovery force of the elastomer 30 still exists, the first pivoting rod 81, the second pivoting rod 82 and the connecting member 70 are counterpoised with each other, so that the recovery force of the elastomer 30 cannot move the movable palate 21 even if the movable stem 22 is released.

Figure 4:
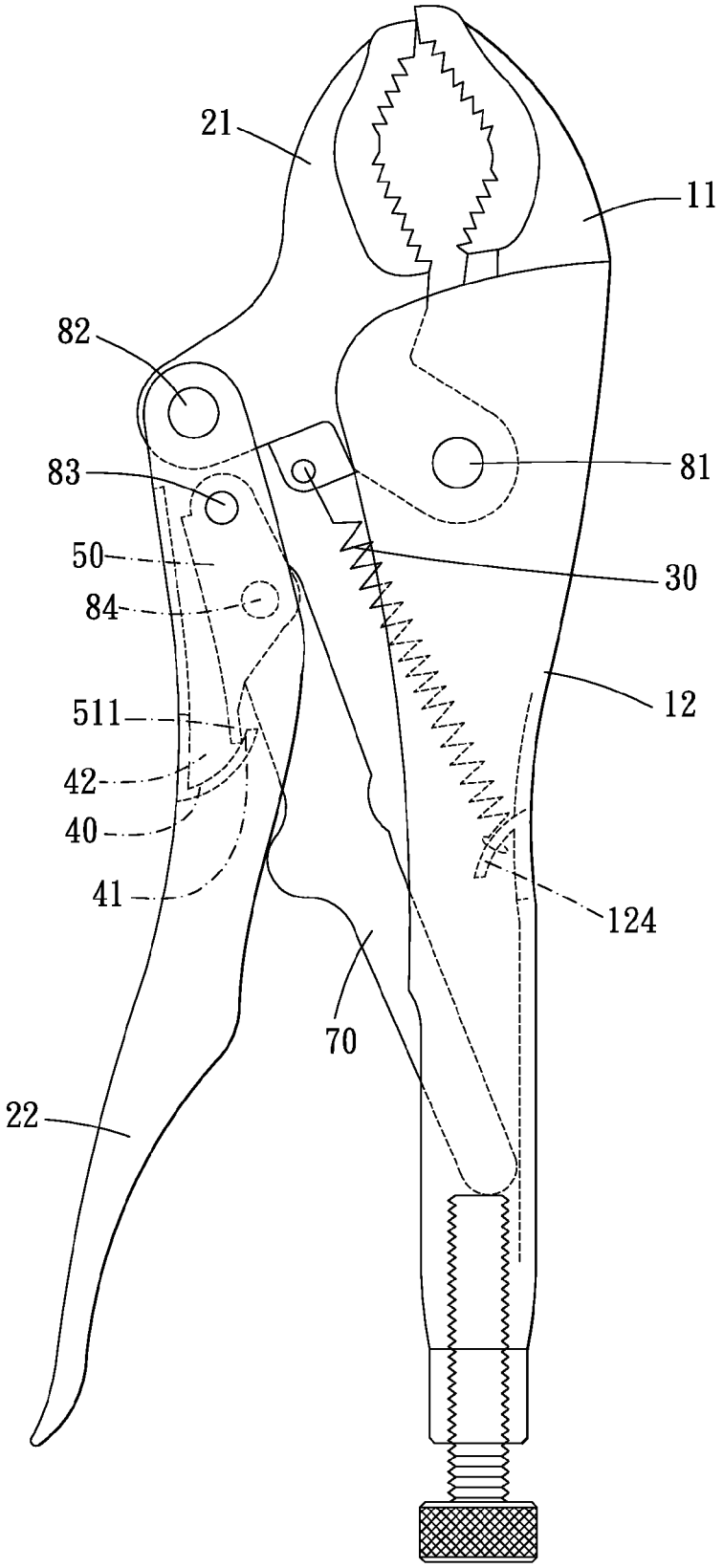
FIG. 4 is a side view for showing the pincer structure under operation.
Figure 5:
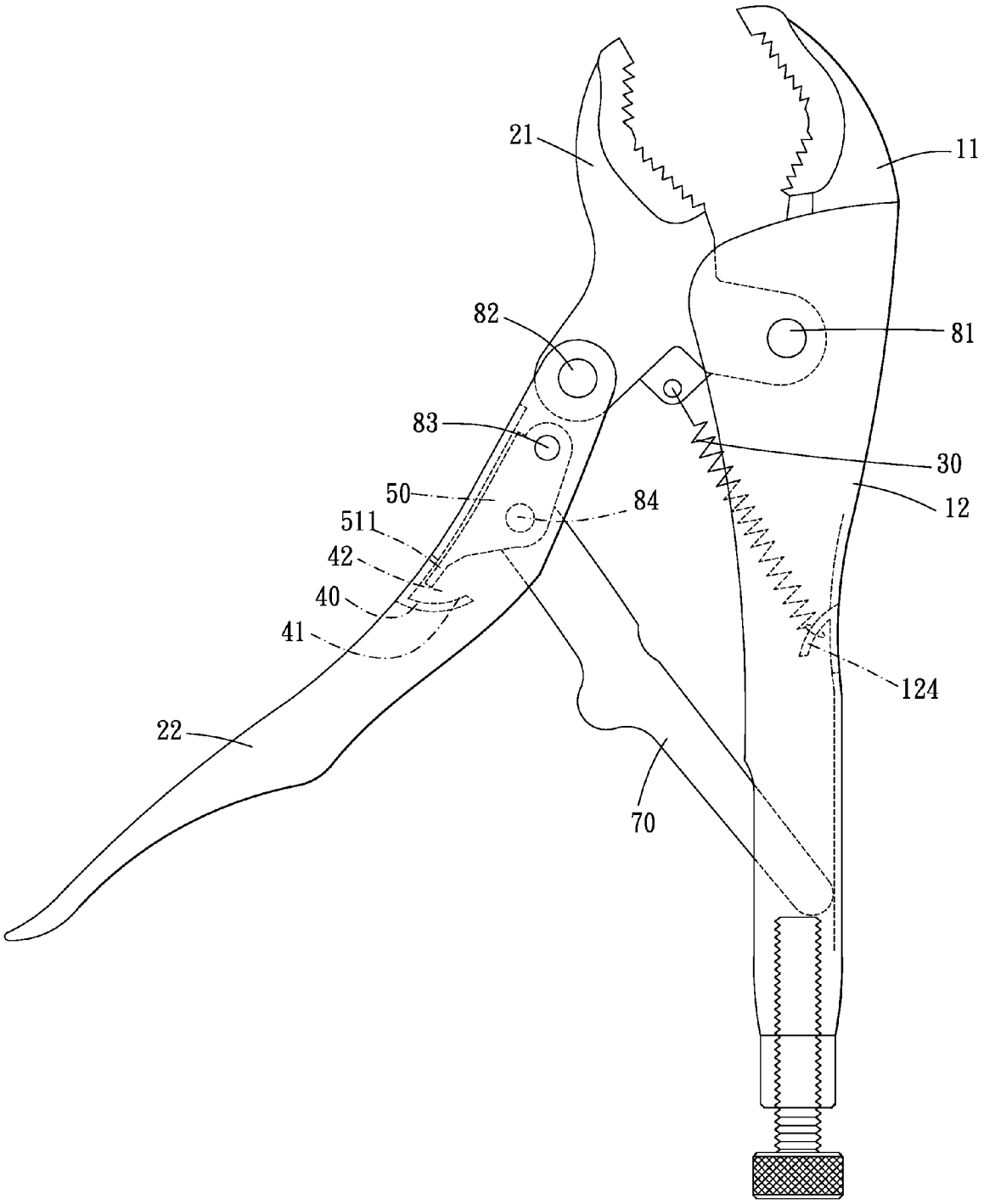
FIG. 5 is a side view for showing the pincer structure under operation.
Figure 6:
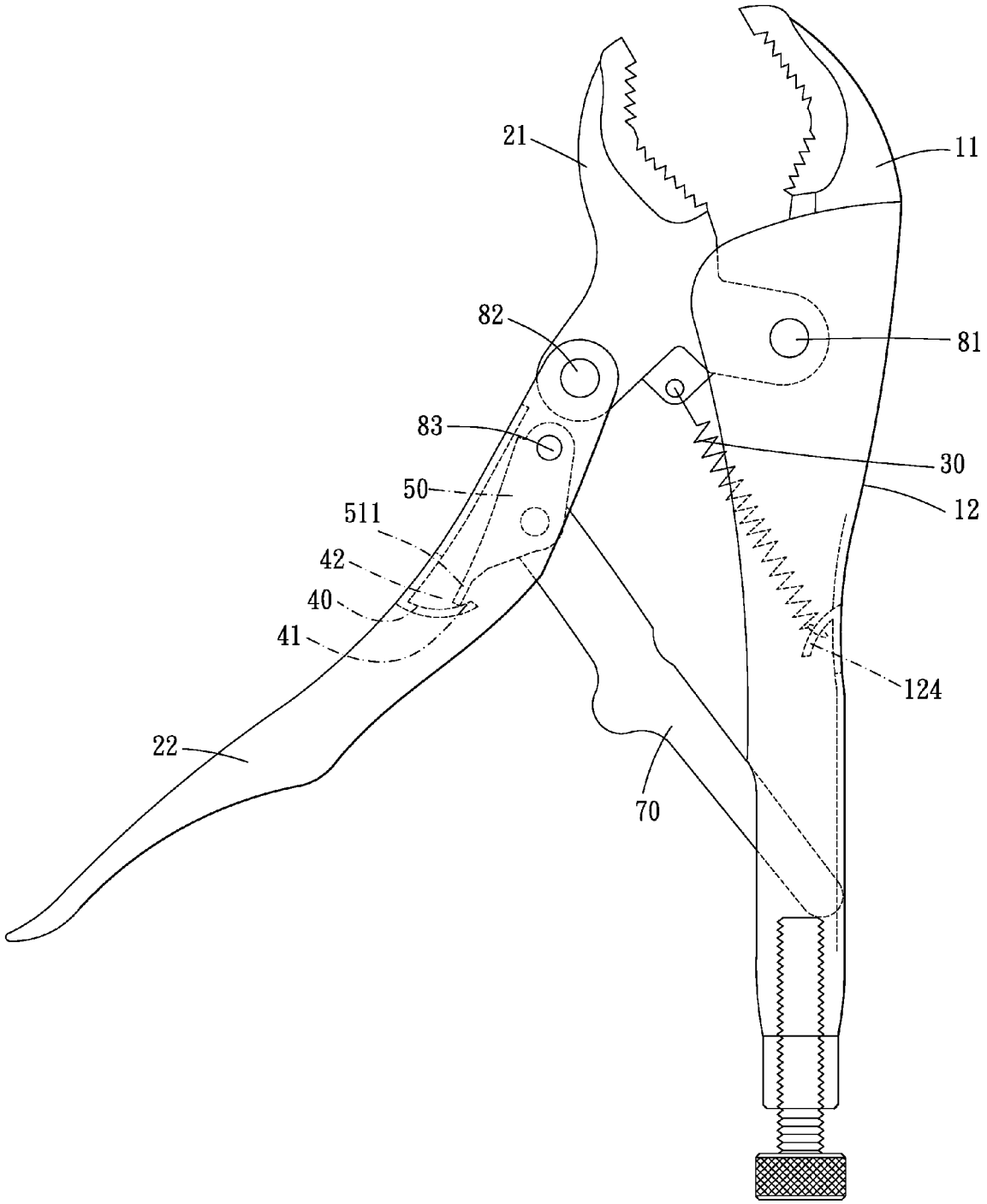
FIG. 6 is a side view for showing the pincer structure under operation.

Referring to FIG. 4, when the movable stem 22 pivots away from the immovable stem 12, the abutting end 511 of the abutting portion 51 of the pivoting member 50 moves toward the abutting unit 41 of the limiting member 40; then, the abutting unit 41 of the limiting member 40 pushes against the pivoting member 50; thereafter, referring to FIG. 5, the connecting member 70 pivots away from the immovable stem 12 so that the connecting member 70 is not axially aligned with the second pivoting rod 82; as a result, the recovery force of the elastomer 30 pulls the movable palate 21 away from the immovable palate 11, and the movable stem 22 is moved away from the immovable stem 12 via motions of the movable palate 21 and the connecting member 70, until the abutting end 511 of the abutting portion 51 of the pivoting member 50 abuts against the abutting unit 41 of the limiting member 40 (as shown in FIG. 6). Therefore, a motion of the movable stem 22 is limited by the pivoting member 50.

Therefore, when a user operates the prevention invention, the user does not need to press the pivoting member 50. In addition, the limiting member 40 is extruded from the bottom portion 221 of the movable stem 22, so that a distance between the limiting member 40 and the bottom portion 221 is adjustable during manufacturing. Furthermore, each lateral portion 222 is extended over the limiting member 40 so that the limiting member 40 is received in the receiving groove 223 and would not be exposed from the receiving groove 223. The relative advantages of the present invention are shown as following.

1. The distance between the limiting member 40 and the bottom portion 221 is shorter than the prior art (U.S. Pat. No. 6,626,070), so that the user just slightly rotates the movable stem 22 away from the immovable stem 12 so as to make the abutting end 511 of the pivoting member 50 abut against the abutting unit 41 of the limiting member 40.

2. When the user rotates the movable stem 22 away from or toward the immovable stem 12, the recovery force of the elastomer 30 makes the operation smooth so that the present invention is easy to operate.

3. During operation, the first, second, third and fourth pivoting rod 81, 82, 83 and 84 would not be worn down because a rotation range of the movable stem 22 is reduced.

4. The limiting member 40 would not interfere with the motion of the connecting member 70. The limiting member 40 is closer to the first stem end 224 of the movable stem 22 than the prior art, so that a length of the abutting portion 51 of the pivoting member 50 dose not need to be enlarged. Therefore, the cost of the pivoting member 50 would not be increased.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pincer structure comprising:

a first body having an immovable palate and an immovable stem, the immovable palate assembled at one end of the immovable stem;

a second body having a movable palate and a movable stem, the movable palate pivoted on the immovable stem, a clipping space defined by the movable palate and the immovable palate, the movable stem pivoted on the movable palate, the movable stem having a bottom portion facing the immovable stem and two lateral portions, the two lateral portions of the movable stem respectively extended from two sides of the bottom portion toward a first direction, the first direction being perpendicular to the movable stem, a receiving groove defined by the bottom portion and the two lateral portions of the movable stem;

an elastomer elastically connected between the movable palate and the immovable stem;

a limiting member interegrally formed from the bottom portion of the movable stem and extending into the receiving groove so that the limiting element is located between the two lateral portions of the movable stem, the limiting member having an abutting unit at an end thereof away from the bottom portion of the movable stem, the abutting unit being located inside the receiving groove, a distance along the first direction between the bottom portion and the abutting unit being smaller than a width of each lateral portion along the first direction, a limiting space defined between the abutting unit and the bottom portion of the movable stem;

a pivoting member pivoted on the movable stem, the pivoting member having an abutting portion, the abutting portion located in the limiting space, the abutting portion being movable between the bottom portion and the abutting unit; and a connecting member having one end and another end, said one end pivotally assembled to the pivoting member, said another end movably assembled to the immovable stem;

wherein the movable stem further has a first stem end and a second stem end; the first stem end of the movable stem is pivoted on the movable palate; the connecting member has an extruded portion extruded therefrom; when the extruded portion abuts against the bottom portion of the movable stem, the limiting member is located between the extruded portion and the first stem end of the movable stem.

2. The pincer structure as claimed in claim 1, wherein the movable stem further has a first stem end and a second stem end; the first stem end of the movable stem is pivoted on the movable palate; the abutting portion has an abutting end extended therefrom toward the second stem end of the movable stem; the abutting end is located at the limiting space; the abutting end is selectively contacted with the abutting unit of the limiting member.

3. The pincer structure as claimed in claim 2, wherein the abutting unit of the limiting member is extended toward the first stem end of the movable stem.

4. The pincer structure as claimed in claim 1, wherein the movable stem further has a first stem end and a second stem end; the first stem end of the movable stem is pivoted on the movable palate; the pivoting member is located between the first end of the movable stem and the limiting member.

5. The pincer structure as claimed in claim 1, wherein the limiting member is hook-shaped.

6. The pincer structure as claimed in claim 1, wherein when the connecting member abuts against the bottom portion of the movable stem, the limiting member is adjacent to one side of the connecting member.

* * * * *